US010016108B2

(12) United States Patent
Barrett

(10) Patent No.: US 10,016,108 B2
(45) Date of Patent: Jul. 10, 2018

(54) AGITATOR ASSEMBLY

(71) Applicant: TECHTRONIC FLOOR CARE TECHNOLOGY LIMITED, Tortola (VG)

(72) Inventor: Edward Thomas George Barrett, West Midlands (GB)

(73) Assignee: Techtronic Floor Care Technology Limited, Tortola (VG)

( * ) Notice: Subject to any disclaimer, the term of this patent is extended or adjusted under 35 U.S.C. 154(b) by 314 days.

(21) Appl. No.: 14/896,583

(22) PCT Filed: Feb. 7, 2014

(86) PCT No.: PCT/GB2014/050363

§ 371 (c)(1),
(2) Date: Dec. 7, 2015

(87) PCT Pub. No.: WO2014/195670

PCT Pub. Date: Dec. 11, 2014

(65) Prior Publication Data

US 2016/0100727 A1 Apr. 14, 2016

(30) Foreign Application Priority Data

Jun. 7, 2013 (GB) ..... 1310202.5

(51) Int. Cl.
*A47L 9/04* (2006.01)
*A47L 11/19* (2006.01)
(Continued)

(52) U.S. Cl.
CPC ..... *A47L 9/0477* (2013.01); *A47L 9/0405* (2013.01); *A47L 9/0455* (2013.01); *A47L 11/19* (2013.01);
(Continued)

(58) Field of Classification Search
CPC ..... A47L 9/04; A47L 9/0405; A47L 9/0411; A47L 9/0427; A47L 9/0444; A47L 9/045;
(Continued)

(56) References Cited

U.S. PATENT DOCUMENTS 1,393,695 A * 10/1921 Paulus ..... A47L 9/0422 15/182
4,701,975 A * 10/1987 Hampton ..... A47L 5/30 15/383
(Continued)

FOREIGN PATENT DOCUMENTS

DE 102010060373 * 5/2012
GB 842668 * 7/1960
(Continued)

OTHER PUBLICATIONS

United Kingdom Patent Office Examination Report for 1310202.5 dated Aug. 5, 2015.
(Continued)

*Primary Examiner* — Mark Spisich
(74) *Attorney, Agent, or Firm* — Michael Best & Friedrich LLP

(57) ABSTRACT

An agitator assembly for a cleaning apparatus including an agitator having a body with first and second ends, and a first alignment formation and a first securing formation at or adjacent the first end; and a drive member operable to impart rotation about a drive axis, and a second alignment formation adapted to cooperate with the first alignment formation, and a second securing formation adapted to engage the first securing formation. Relative axial movement of the agitator in a first direction towards the drive member causes contact between the first and second alignment formations. Further relative axial movement of the agitator in the first direction causes relative rotation between the agitator and drive member and yet further relative axial movement of the
(Continued)

agitator in the first direction causes engagement between the first and second securing formations, substantially to prevent further relative rotational movement between the agitator and drive member.

19 Claims, 4 Drawing Sheets

(51) Int. Cl.
*A47L 11/282* (2006.01)
*A47L 11/40* (2006.01)

(52) U.S. Cl.
CPC ..... *A47L 11/282* (2013.01); *A47L 11/4041* (2013.01); *A47L 11/4069* (2013.01)

(58) Field of Classification Search
CPC ..... A47L 9/0477; A47L 9/0455; A47L 11/18; A47L 11/19; A47L 11/24; A47L 11/282; A47L 11/32; A47L 11/33; A47L 11/4041; A47L 11/4069
USPC ..... 15/52.1, 41.1, 383, 389–392, 179, 182
See application file for complete search history.

(56) References Cited

U.S. PATENT DOCUMENTS 4,912,805 A * 4/1990 Krasznai ..... A47L 9/0444 15/182
6,324,714 B1 * 12/2001 Walz ..... A46B 13/001 15/392
2011/0047746 A1 * 3/2011 Butts ..... A47L 9/0411 15/383
2011/0303239 A1 12/2011 Harrison
2013/0174373 A1 * 7/2013 Genn ..... A47L 9/04 15/383
2014/0196236 A1 * 7/2014 Ventress ..... A46B 13/005 15/182

FOREIGN PATENT DOCUMENTS

| | | | |
|---|---|---|---|
| GB | 2443364 | | 4/2008 |
| JP | 6-54779 | * | 3/1994 |
| JP | 2009219620 | | 10/2009 |
| JP | 2009-261807 | * | 11/2009 |
| WO | 2011158596 | | 12/2011 |

OTHER PUBLICATIONS

United Kingdom Search Report for Application No. 1310202.5 dated Sep. 16, 2013 (1 page).
International Search Report for Application No. PCT/GB2014/050363 dated May 14, 2014 (2 pages).
Images of Dyson DC48 Vacuum, discovered on sale by Applicant on Jul. 12, 2013.

* cited by examiner

AGITATOR ASSEMBLY

CROSS-REFERENCE TO RELATED APPLICATIONS

This application is a Section 371 national phase application of International Application No. PCT/GB2014/050363, filed Feb. 7, 2014, which claims priority to U.K. Patent Application No. GB 1310202.5, filed Jun. 7, 2013, the entire contents all of which are hereby incorporated by reference herein.

BACKGROUND

This invention relates to an agitator assembly for use in a surface treatment apparatus.

A typical carpet-washing machine, for washing a carpet in the course of being moved over its surface, comprises a body which carries a tank for containing a quantity of a cleaning liquid, normally water containing an appropriate quantity of at least one treatment agent such as a suitable detergent. The machine has a cleaning head, at or in the vicinity of which the cleaning solution is delivered to the carpet, e.g. through one or more delivery nozzles. The cleaning head commonly provides an agitator device, by which the cleaning solution is worked into the pile of the carpet for effective cleaning. An agitating device may comprise a motor-driven rotatable brush bar or agitator roller.

The device also incorporates a source of suction, usually an electric motor driving an impeller fan for creating a suction airflow, to draw dirty cleaning liquid from the pile of the carpet after cleaning. A suction nozzle associated with the cleaning head closely faces the carpet to draw the liquid therefrom and the suction airflow passes through a suitable duct or passageway extending from the suction nozzle to a recovery tank for the dirty liquid. In the recovery tank the suction airflow is caused to follow a tortuous path in which the entrained dirty liquid is caused to separate from the airflow, with the air passing from the recovery tank to the source of suction by way of a suitable exit duct. Finally, the airflow is discharged to the surrounding atmosphere.

SUMMARY

According to an aspect of the invention we provide an agitator assembly for use in a cleaning apparatus, the assembly including:

an agitator comprising a body with a first and a second end, and a first alignment formation and a first securing formation at or adjacent the first end; and a drive member operable to impart rotation about a drive axis, and providing a second alignment formation adapted to cooperate with the first alignment formation, and a second securing formation adapted to engage the first securing formation;

wherein relative axial movement of the agitator in a first direction towards the drive member causes contact between the first and second alignment formations;

further relative axial movement of the agitator in the first direction causes relative rotation between the agitator and drive member; and yet further relative axial movement of the agitator in the first direction causes engagement between the first and second securing formations, substantially to prevent further relative rotational movement between the agitator and drive member.

According to another aspect of the invention we provide an agitator assembly for use in a cleaning apparatus, the assembly including:

an agitator comprising a body with a first and a second end, and a first alignment formation at or adjacent the first end and a user-graspable member at the second end, the user-graspable member being rotatable relative to the body; and a drive member operable to impart rotation about a drive axis, and providing a second alignment formation adapted to cooperate with the first alignment formation;

wherein relative axial movement of the agitator in a first direction towards the drive member causes contact between the first and second alignment formations;

further relative axial movement of the agitator in the first direction causes relative rotation between the agitator and drive member, and relative rotation between the body and the user-graspable member of the agitator.

Further features of the above aspects of the invention are described in the appended claims.

The invention has been devised, and is hereafter described, in relation to a device for cleaning a floor surface, more particularly a carpet-washing machine for washing carpets, in which the treatment comprises application of a treatment liquid to the surface and subsequent removal of (at least a substantial proportion of) the liquid. It will be appreciated that the invention may find application in relation to the treatment of other surfaces than floors, to floor surfaces other than carpets, and to treatment other than cleaning.

DETAILED DESCRIPTION

Figure 1:
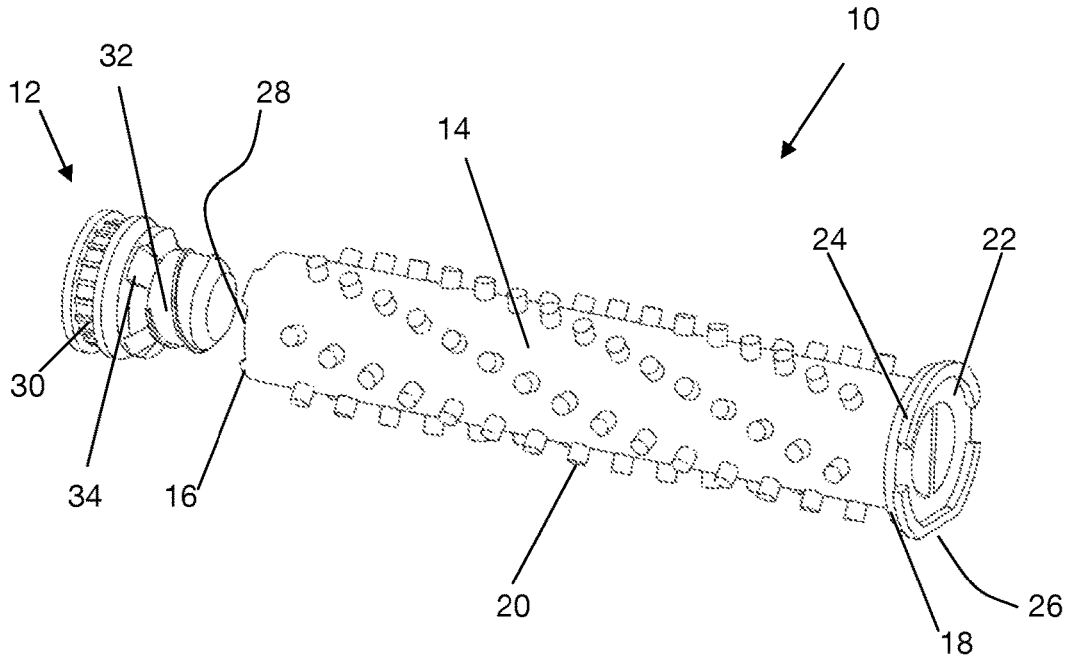
FIG. 1 is a perspective view of an agitator and drive member according to an embodiment of the invention.

With reference to the Figures, an agitation assembly is shown, including an agitator 10 and a drive assembly. In embodiments, the drive assembly includes a motor 31 and a drive member 12, the motor 31 being configured to impart rotational drive to the drive member 12 to cause the drive member 12 to rotate about a drive axis. In other embodiments, the drive assembly does not include a motor to impart drive to the drive member 12—instead, a drive belt may transfer rotational drive from an axle supporting one or more wheels of the cleaning apparatus, for example. In such an embodiment, movement of the cleaning apparatus over a surface causes rotation of the drive member.

The agitator 10 has an elongate body 14 and a first end 16 configured to be secured to the drive member 12, and a user-graspable member disposed at its second end 18. In embodiments, the user-graspable member is an end cap 22 that provides a cover for an aperture defining a housing 44 in which the agitator is inserted into the cleaning apparatus. The body 14 forms a rotatable brush bar comprising a plurality of bristles 20 that extend radially outwards from the body 14. The bristles 20 may be formed of any suitable material, as is generally known in the art for cleaning devices of this type.

Figure 4:
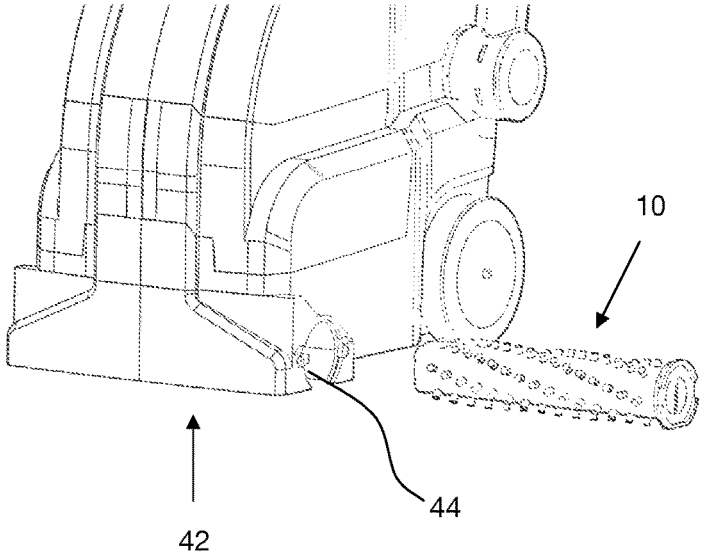
FIG. 4 is a perspective view of an agitator shown in relation to a surface treatment apparatus.
Figure 8:
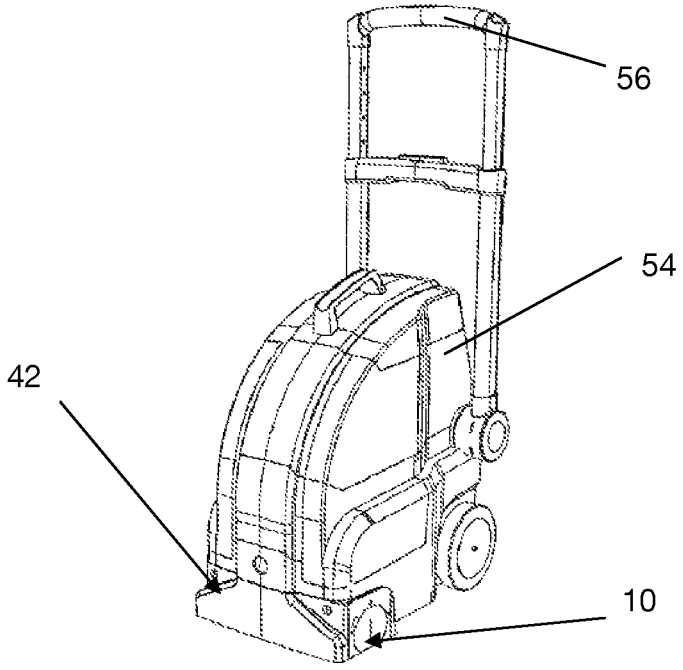
FIG. 8 is a perspective view of a cleaning apparatus including the agitator.

As shown in FIGS. 4 and 8, the agitator assembly is disposed within a cleaning head 42 of a cleaning apparatus. The cleaning apparatus is typically a carpet washing apparatus, having a body 54 and a handle 56 to enable a user to control movement of the apparatus. As the motor 31 is operated, the drive member 12 is driven by a drive belt 33, provided around a portion of a pulley 30 provided on the drive member 12. The drive belt 33 may be a timing belt, a ribbed belt, a V-belt, or any other suitable type of belt. The action of the belt 33 driven by the motor 31 transmits rotational drive to the drive member 12, causing it to rotate about its central axis. The rotation of the brush bar causes the bristles to impinge upon the surface being cleaned, so as to remove or dislodge dirt and/or fibres from the surface, allowing that debris to be sucked into the cleaning apparatus under the suction provided by a vacuum source within the apparatus. The apparatus may also include a tank storing cleaning solution, which may be sprayed onto the surface being cleaned. The brush bar may work cleaning solution into the pile of a carpet being cleaned, to improve the effectiveness cleaning of the cleaning process.

In use, the agitator is disposed within a housing 44 provided within the cleaning head 42 of the cleaning apparatus. During use the bristles 20 of the brush bar may become worn, dirty, or otherwise damaged, and the brush bar may be removed from the housing 44 by a user, to replace, repair or clean the brush bar. The housing 44 forms a partial sleeve around the brush bar, providing an opening at one end so that the brush bar may be inserted axially. The lowermost portion of the housing provides an opening, so that the bristles 20 of the brush bar contact and impinge upon the surface underneath the apparatus as it moves over the surface and/or as the brush bar rotates relative to the surface.

The agitator 10 has a first alignment formation 40 and a first securing formation 38 at or adjacent a first end 16. The first alignment formation 40 is adapted to cooperate with a second alignment formation 36 provided on the drive member 12. The first securing formation 38 is adapted to engage a second securing formation 34 provided on the drive member 12.

Figure 2:
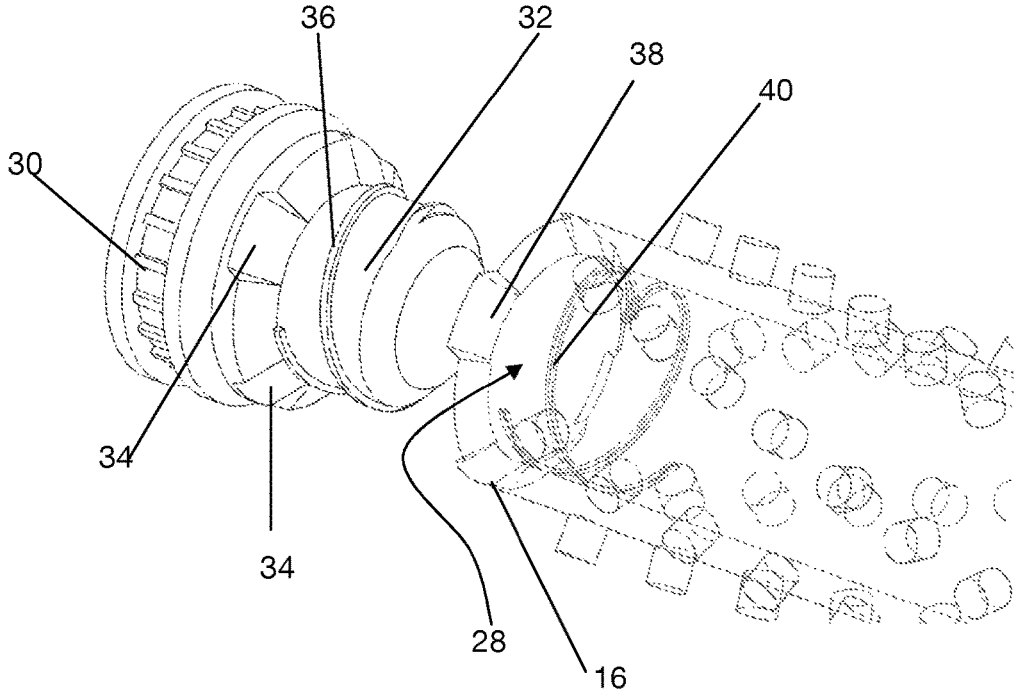
FIG. 2 is a perspective view of a portion of the agitator and drive member shown in FIG. 1, wherein the internal portions of the agitator and shown.
Figure 3:
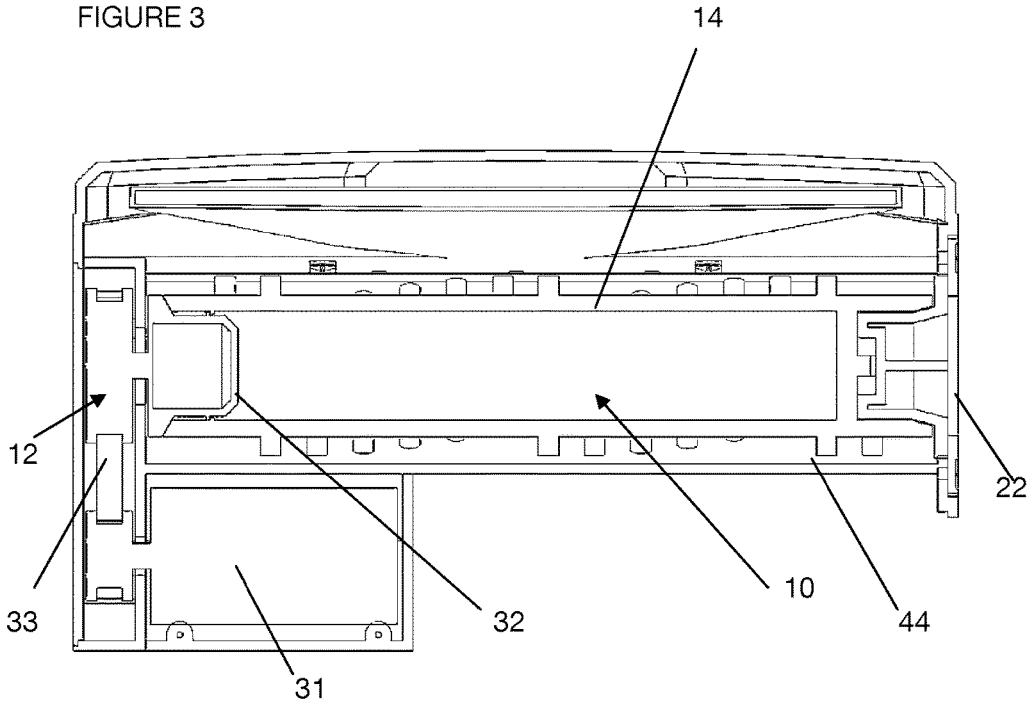
FIG. 3 is a top-down cross-sectional view of an agitator assembly shown in relation to a portion of a surface treatment apparatus.
Figure 5:
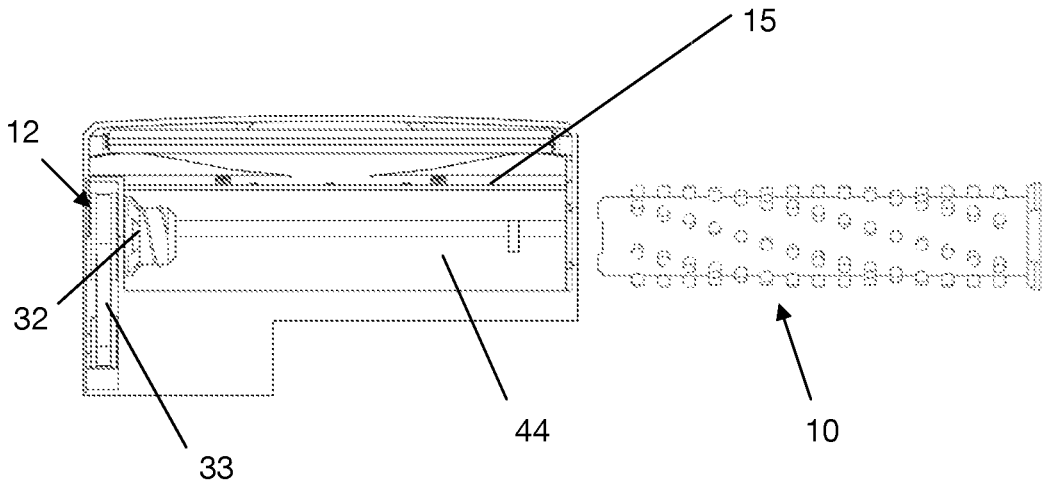
FIG. 5 is a top-down view of an agitator assembly.
Figure 6:
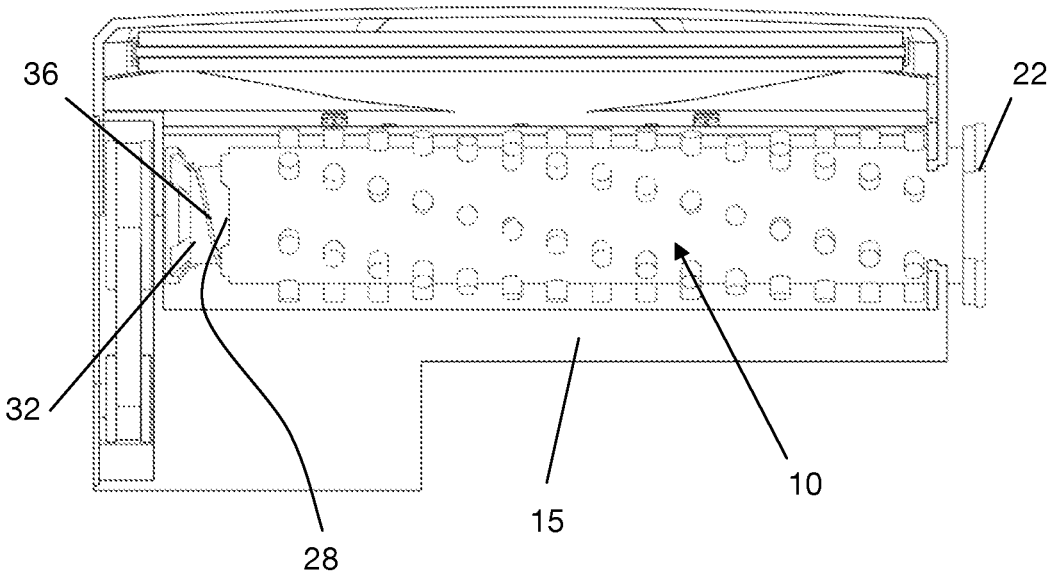
FIG. 6 is a top-down view of the agitator assembly.

As shown in FIGS. 5 and 6, the agitator 10 is inserted axially into the housing 44, towards the drive member 12 disposed at the far end of the housing 44 from the opening. One of the drive member 12 and the first end 16 of the agitator 10 provides a protruding portion and the other provides a recess adapted to receive the protruding portion so as substantially to prevent relative radial movement between the drive member 12 and the first end 16 of the agitator 10. The protruding portion and recess each provide a respective one of the alignment formations 40, 36. In embodiments, and as shown in FIG. 2, the protruding portion 32 is provided on the drive member 12 and the recess 28 is provided within the first end 16 of the agitator 10. It should be understood that in other embodiments, the protruding portion may be provided at the first end 16 of the agitator 10, and the recess may be provided in the drive member 12.

In embodiments, the first and second alignment formations 40, 36 comprise cooperating threaded portions. The threaded portions may define a helical portion, for example. The helical portion may define a complete helix or only a portion of the circumference of a helix. As shown in FIG. 2, the threaded portions define cooperating twin start threads, so that when the agitator 10 comes into contact with the drive member 12, the corresponding threads engage one another with ease, and preventing the agitator 10 and/or drive member 12 having to rotate through an angle of more than 180 degrees before the corresponding threaded portions fully engage one another.

In other embodiments, one of the first and second alignment formations 40, 36 comprises a threaded portion (such as a partial helix, for example), formed as a ridge, for example, and the other of the first and second alignment formations 40, 36 provides a cooperating formation adapted to contact the threaded portion, such that relative axial movement between the first and second alignment formations 40, 36 towards one another causes relative rotational movement between the two. For example, the cooperating formation may be provided by one or more pins configured to contact the ridge of the threaded portion so as to cause relative rotation between those parts as the pins abut the threaded portion and are moved towards it.

As the agitator 10 moves axially into and through the housing 44, relative axial movement of the agitator 10 in a first direction towards the drive member 12 causes contact between the first and second alignment formations 40, 36. Once the threaded portions 40, 36 initially contact one another, further relative axial movement of the agitator 10 in the first direction causes relative rotation between the body 14 of the agitator 10 and drive member 12 due to the helical configuration of the threaded portions.

As the axial movement of the agitator continues in the first direction, the brush bar rotates until the threaded portion of the drive member 12 ends. The configuration of the alignment formations 40, 36 and the securing formations 38, 34 is such that at the point where the threaded portion ends, the first and second securing formations 38, 34 are directly axially aligned with one another. Thus, as the threaded portion ends, further relative axial movement of the brush bar in the first direction causes engagement between the first and second securing formations 38, 34, causing them to engage and interlock. When the securing formations 38, 34 are engaged with one another, further relative rotational movement between the agitator 10 and drive member 12 is substantially prevented.

In embodiments, and as shown in FIGS. 1 and 2, the first and second securing formations 38, 34 each comprise one or more cooperating ridges and grooves adapted to engage corresponding grooves and ridges of the other respective formation. The grooves and ridges alternate in a castellated formation, and are disposed circumferentially about the axis. In embodiments, and as shown in the Figures, the securing formations 38, 34 are disposed radially outward of the alignment formations 40, 36 from the drive axis. Thus, when the grooves of the first securing formation 38 engage with the ridges of the second securing formation 34, and vice versa, any rotation of the drive member 12 causes identical rotation of the brush bar, since the two are held rotationally fast to one another.

Figure 7:
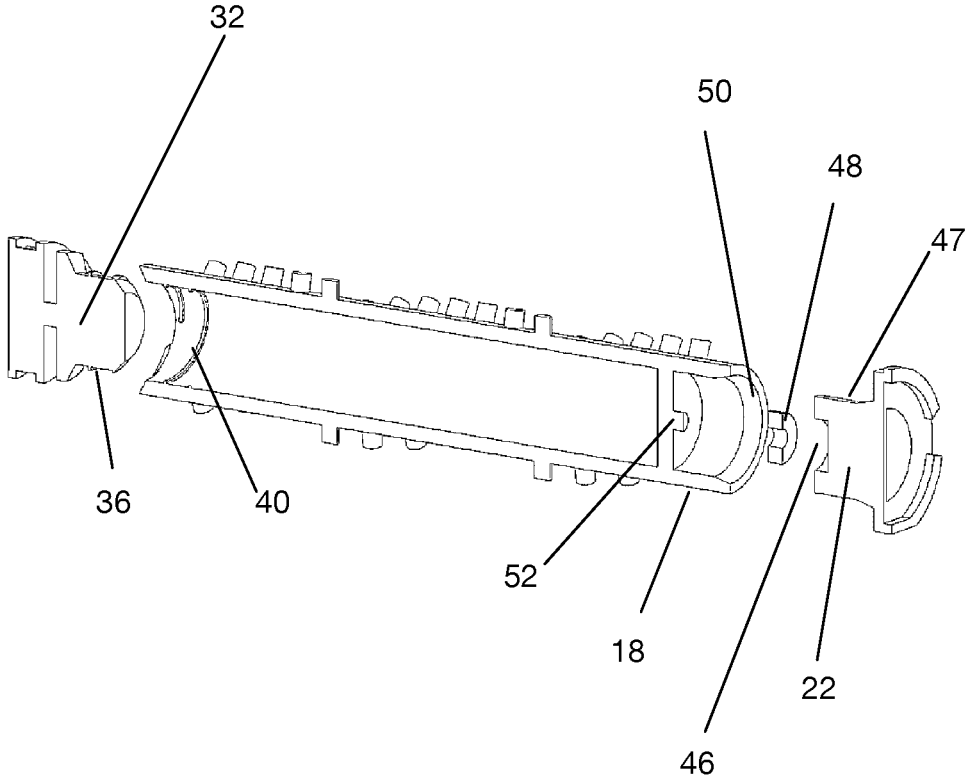
FIG. 7 is an exploded perspective cross-sectional view of an agitator and drive member.

At the second end 18 of the agitator 10, the user-graspable member—an end cap 22 in this case—provides a bearing on which the second end of the body 14 of the agitator 10 is mounted for rotation relative to the end cap 22. In embodiments, as shown in FIG. 7, the end cap 22 provides a protruding part 47 that fits within a corresponding recess 50 defined in the second end 18 of the body 14 of the agitator 10. An annular bearing 48 is disposed around a pin 52 provided within the recess 50 within the second end 18, on the central axis of the body 14. The annular bearing 48 sits in an annular groove 46 formed within the protruding part 47 of the end cap 22, disposed between the pin 52 and a wall surrounding the groove 46, enabling rotation between the end cap 22 and the body 14 providing the brush bar.

When the agitator 10 is inserted into the housing 44 by a user, it moves axially through the housing 44 towards the drive member 12. As the first 40 and second 36 alignment formations contact one another, the user continues to push the end cap 22 axially. The user does not rotate the end cap 22 of the agitator in order to cause it to rotate—rather, the body 14 of the agitator 10 is caused to rotate relative to the drive member 12 due to the threading of the alignment formations 40, 36. This causes the body 14 of the agitator to rotate relative to the end cap 22. The user continues to push the end cap 22 axially, and eventually the threaded portions end, causing the relative rotation to cease. In that position, the ridges and grooves of the first and second 38, 34 securing formations are aligned with one another, such that further movement of the end cap 22 in the first direction causes the ridges of the first securing formation 38 to engage the grooves of the second securing formation 34, and vice versa. No rotation of the end cap 22 is required at any point to cause alignment and subsequent engagement of the securing formations 38, 34, which simplifies the process of inserting and securing the brush bar within the housing 44.

The end cap 22 provides a ridge 24 around a portion of its circumference, to provide a close fit with the aperture into which the end cap 22 fits on full insertion of the brush bar into the housing 44. A portion of the end cap 22 provides a part capable of being gripped by the fingers of a user, or to receive a tool for releasing the end cap 22, when the end cap 22 is flush with the aperture provided in the housing 44. In embodiments, and as shown in FIG. 1, this part is an inset portion 26 defining an opening between the end cap 22 and the edge of aperture receiving the end cap 22.

To remove the brush bar from the housing 44, a user may use his fingers, a tool, or the like, to engage the inset portion 26 of the end cap 22, so as to dislodge and remove the end cap 22 from its respective aperture in the housing 44. As the end cap 22 is pulled outwardly from the apparatus, in the second direction, axially away from the drive member 12, the first and second securing formations 38, 34 disengage from one another. This allows the body 14 of the agitator 10 to rotate relative to the drive member 12. Further movement of the end cap 22 in the second direction causes the first and second aligning formations to come into contact, and the body 14 rotates relative to the drive member 12 until those formations are no longer in contact. Further movement of the agitator 10 causes the protruding portion 32 of the drive member 12 to disengage the recess of the first end 16 of the agitator 10, and the brush bar is subsequently withdrawn from the housing 44.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An agitator assembly for use in a cleaning apparatus, the agitator assembly including:

an agitator including a body with a first end and a second end, and a first alignment formation and a first securing formation adjacent the first end; and a drive member operable to impart rotation about a drive axis, and including a second alignment formation adapted to cooperate with the first alignment formation, and a second securing formation adapted to engage the first securing formation;

wherein relative axial movement of the agitator in a first direction towards the drive member causes contact between the first and second alignment formations;

further relative axial movement of the agitator in the first direction causes relative rotation between the agitator and the drive member; and yet further relative axial movement of the agitator in the first direction causes engagement between the first and second securing formations, substantially to prevent further relative rotational movement between the agitator and the drive member.

2. An agitator assembly according to claim 1, wherein the agitator includes a user-graspable member at the second end, the user-graspable member being rotatable relative to the body such that further relative axial movement of the agitator in the first direction following contact between the agitator and the drive member causes relative rotation between the body and the user-graspable member of the agitator.

3. An agitator assembly according to claim 2, wherein the user-graspable member provides a bearing on which the second end of the agitator is mounted for rotation relative to the user-graspable member.

4. An agitator assembly according to claim 1, wherein the drive member is comprised by a drive assembly that further includes a motor, the motor being configured to impart rotational drive to the drive member to cause the drive member to rotate about the drive axis.

5. An agitator assembly according to claim 4, wherein the motor is connected to the drive member by a drive belt.

6. An agitator assembly according to claim 1, wherein the first and second alignment formations comprise cooperating portions, at least one of the first and second alignment formations comprising a threaded portion.

7. An agitator assembly according to claim 6, wherein the threaded portion defines cooperating twin start threads.

8. An agitator assembly according to claim 1, wherein one of the first and second alignment formations comprises a threaded portion and the other of the first and second alignment formations provides a cooperating formation adapted such that relative axial movement of the first alignment formation towards the second alignment formation causes relative rotational movement between the first and second alignment formations.

9. An agitator assembly according to claim 1, wherein one of the drive member and the first end of the agitator provides a protruding portion and the other provides a recess adapted to receive the protruding portion so as substantially to prevent relative radial movement between the drive member and the first end of the agitator.

10. An agitator assembly according to claim 9, wherein the protruding portion and recess each provide a respective one of the alignment formations.

11. An agitator assembly according to claim 9, wherein the protruding portion is provided on the drive member and the recess is provided within the first end of the agitator.

12. An agitator assembly according to claim 1, wherein the first and second securing formations each comprise one or more cooperating ridges and grooves adapted to engage corresponding grooves and ridges of the other respective formation.

13. An agitator assembly according to claim 12, wherein each of the first and second securing formations comprises a plurality of alternate grooves and ridges disposed circumferentially about the axis.

14. An agitator assembly according to claim 1, wherein the body is a brush bar comprising a plurality of bristles.

15. An agitator assembly for use in a cleaning apparatus, the agitator assembly including:

an agitator including a body with a first end and a second end, and a first alignment formation adjacent the first end and a user-graspable member at the second end, the user-graspable member being rotatable relative to the body; and a drive member operable to impart rotation about a drive axis, and including a second alignment formation adapted to cooperate with the first alignment formation;

a first securing formation is provided adjacent the first end of the agitator;

a second securing formation is provided at the drive member that is adapted to engage the first securing formation;

wherein relative axial movement of the agitator in a first direction towards the drive member causes contact between the first and second alignment formations;

wherein further relative axial movement of the agitator in the first direction causes relative rotation between the agitator and the drive member, and relative rotation between the body and the user-graspable member of the agitator; and wherein yet further relative axial movement of the agitator in the first direction, causes engagement between the first and second securing formations, substantially to prevent further relative rotational movement between the agitator and the drive member.

16. An agitator assembly according to claim 15, wherein one of the first and second alignment formations comprises a threaded portion and the other of the first and second alignment formations provides a cooperating formation adapted such that relative axial movement of the first alignment formation towards the second alignment formation causes relative rotational movement between the first and second alignment formations.

17. An agitator assembly according to claim 15, wherein one of the drive member and the first end of the agitator provides a protruding portion and the other provides a recess adapted to receive the protruding portion so as substantially to prevent relative radial movement between the drive member and the first end of the agitator.

18. An agitator assembly according to claim 17, wherein the protruding portion and recess each provide a respective one of the alignment formations.

19. An agitator assembly according to claim 17, wherein the protruding portion is provided on the drive member and the recess is provided within the first end of the agitator.

* * * * *